US005374206A

United States Patent [19]

Gregory

[11] Patent Number: 5,374,206

[45] Date of Patent: Dec. 20, 1994

[54] PEDAL OPERATED WATERCRAFT

[76] Inventor: Jack T. Gregory, 172 Wildmoor Reach, Sea Ranch, Calif. 95497

[21] Appl. No.: 8,098

[22] Filed: Jan. 22, 1993

Related U.S. Application Data

[63] Continuation of Ser. No. 819,475, Jan. 10, 1992, abandoned.

[51] Int. Cl.[5] ..... B63H 16/20

[52] U.S. Cl. ..... 440/57; 440/27

[58] Field of Search ..... 440/21-32, 440/53, 67, 63; 114/61, 283, 284, 292, 144 R, 144 A; 474/144, 147, 151, 152, 154, 157

[56] References Cited

U.S. PATENT DOCUMENTS

| | | | |
|---|---|---|---|
| 2,238,844 | 4/1941 | Arbeitlang | 114/162 |
| 2,399,500 | 4/1946 | Montalbano | 440/30 |
| 2,518,808 | 8/1950 | Nadolinski | 440/31 |
| 2,775,950 | 1/1957 | Dearmond | 440/30 |
| 3,083,382 | 4/1963 | Havens et al. | 440/26 |
| 3,257,987 | 6/1966 | Liard | 440/31 |
| 3,265,026 | 8/1966 | Hamilton | 114/61 |
| 3,317,905 | 4/1972 | Galkin | 440/26 |
| 3,661,108 | 5/1972 | Sorenson | 114/61 |
| 3,866,557 | 2/1975 | Lang | 114/61 |
| 3,970,025 | 7/1976 | Sovia | 114/61 |
| 4,286,533 | 9/1981 | Sanner | 114/61 |
| 4,427,392 | 1/1984 | Schneider | 440/30 |
| 4,459,116 | 7/1984 | Moore | 440/31 |
| 4,648,846 | 3/1987 | Hsu | 440/31 |
| 4,698,034 | 10/1987 | Anthonijsz | 440/27 |
| 4,936,595 | 6/1990 | Cunningham | 114/344 |
| 4,968,274 | 11/1990 | Gregory | 114/61 |
| 5,011,441 | 4/1991 | Foley | 114/61 |
| 5,030,145 | 7/1991 | Chase | 440/26 |
| 5,054,411 | 10/1991 | Nelson | 114/61 |

FOREIGN PATENT DOCUMENTS

| | | |
|---|---|---|
| 902023 | 4/1945 | France . |
| 1076257 | 10/1954 | France . |
| 1315814 | 12/1962 | France . |
| 2591995 | 12/1985 | France . |
| 2418614 | 10/1975 | Germany . |
| 602270 | 2/1960 | Italy . |
| 628156 | 11/1961 | Italy . |

*Primary Examiner*—Robert J. Oberleitner
*Attorney, Agent, or Firm*—Hawes & Fischer

[57] ABSTRACT

The improved watercraft of the instant invention includes design advantages such as solidly connected arm drive handles to augment power from the drive pedals; a fully pivoting drive assembly which pivots along with the steering mechanism; an angularly pivotable propeller, pivotable toward the outside pontoon during a turn to assist in turning; a compact structure for transmitting mechanical power from the pedals and the arm drive handles to the propeller; and other design aspects.

16 Claims, 5 Drawing Sheets

FIG. 1
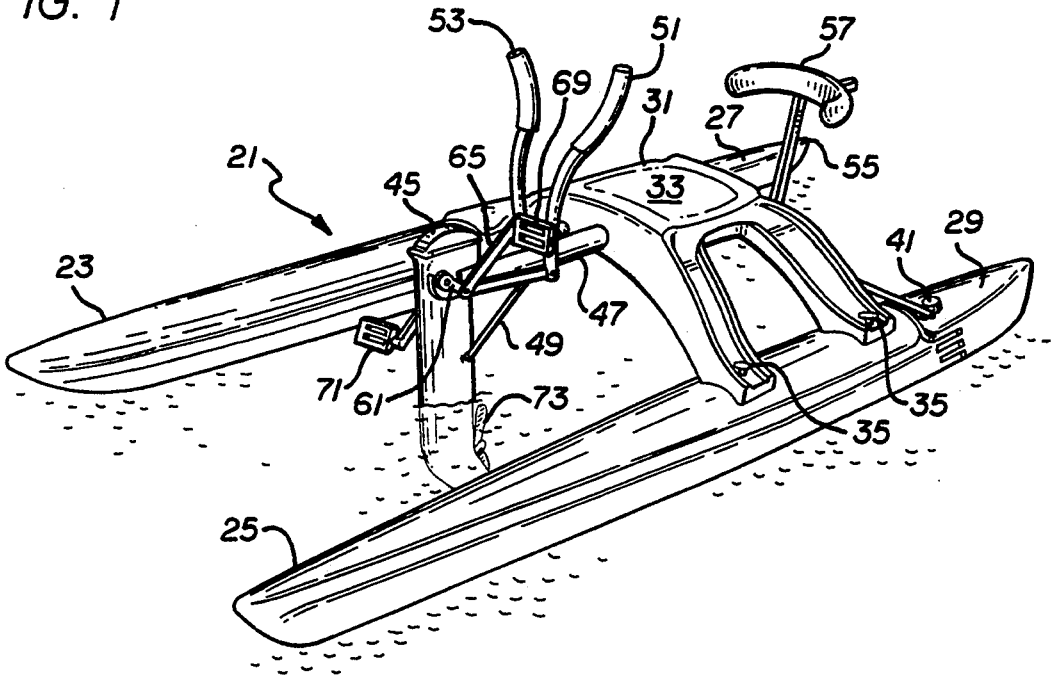
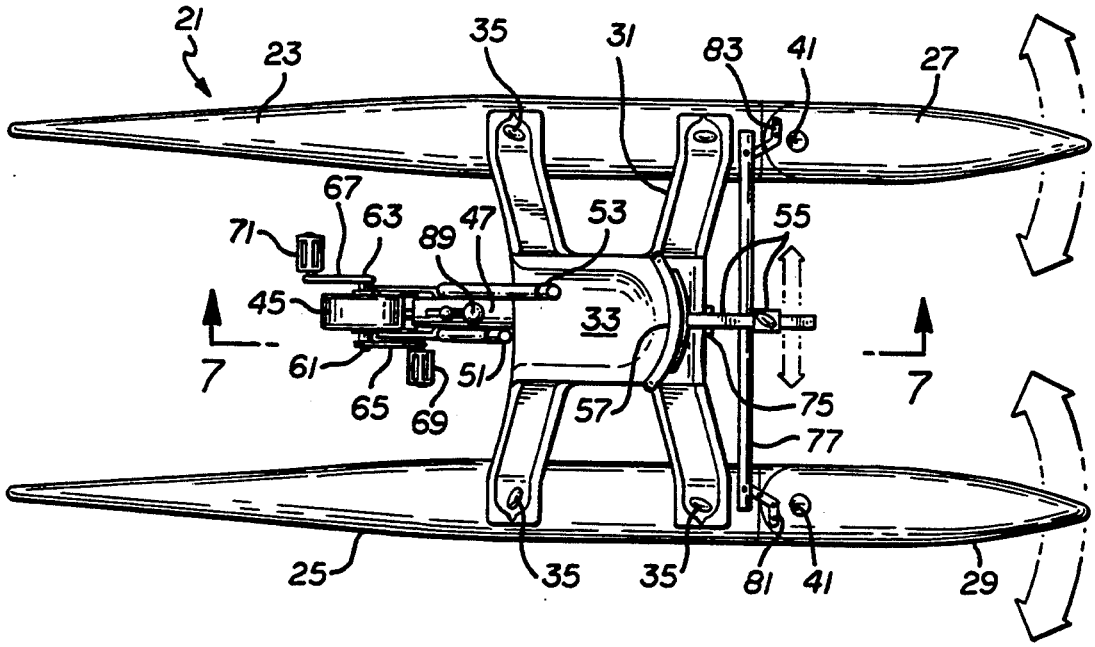
FIG. 2

FIG. 3
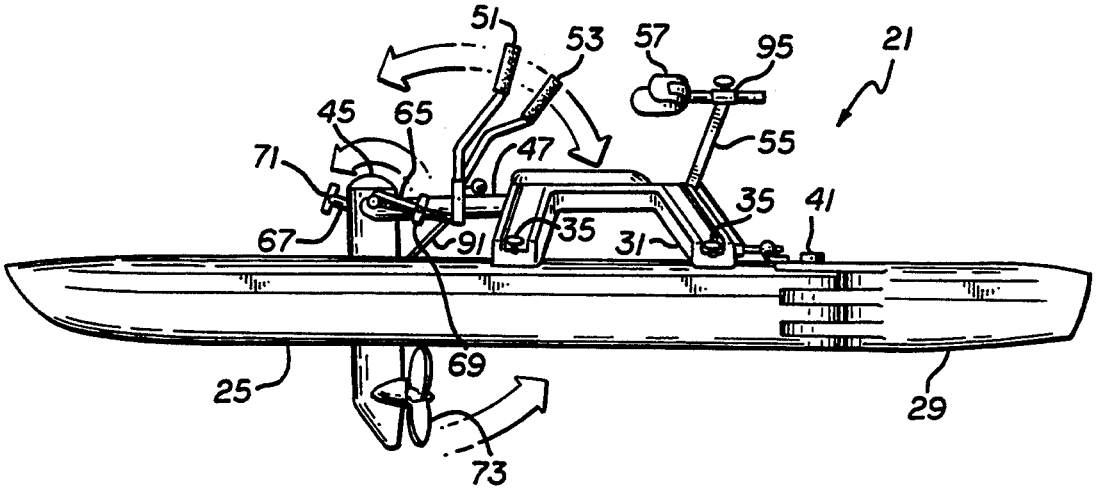
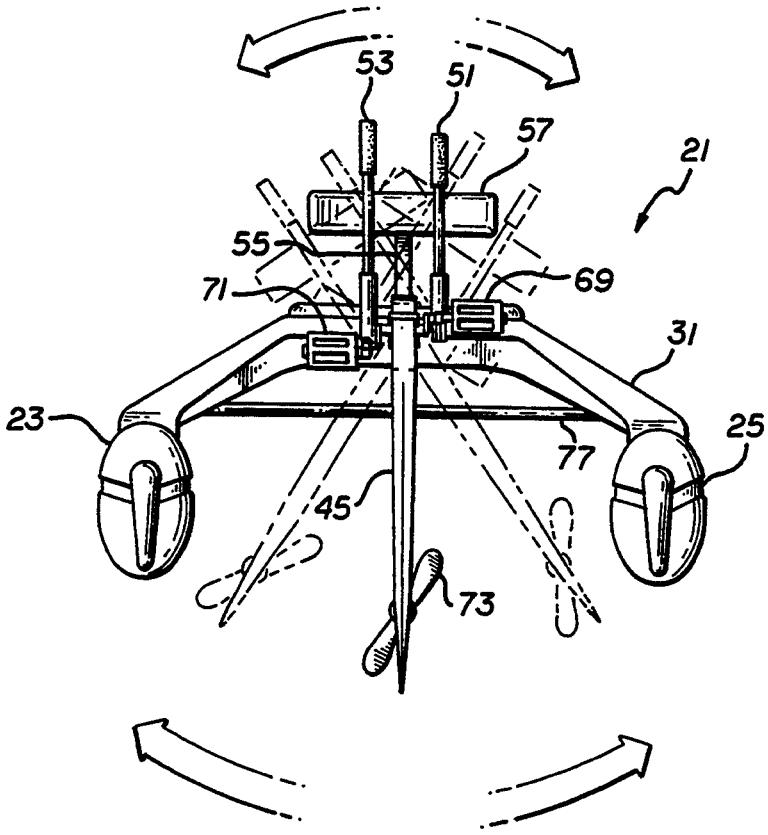
FIG. 4

FIG. 5
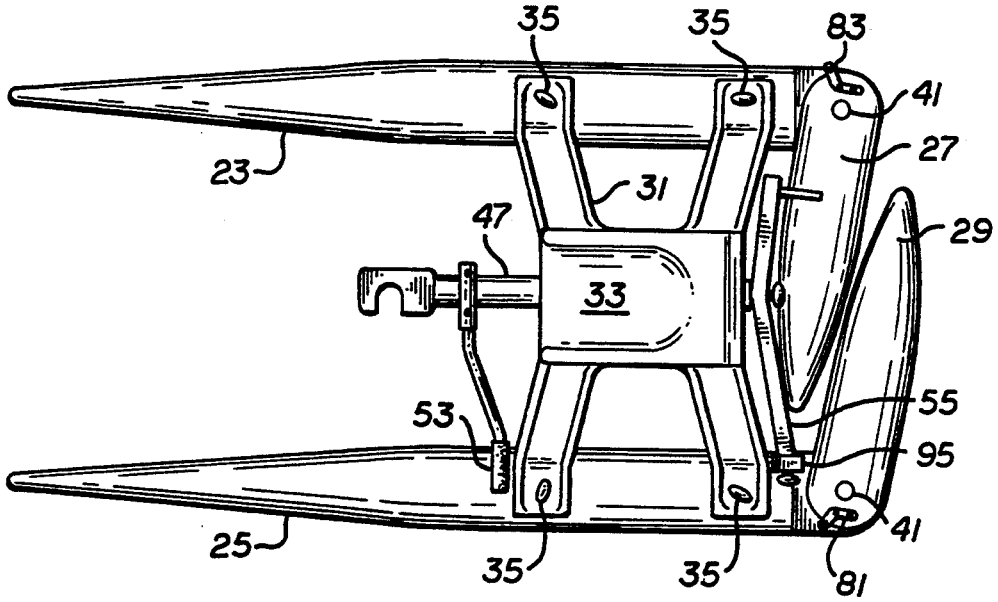
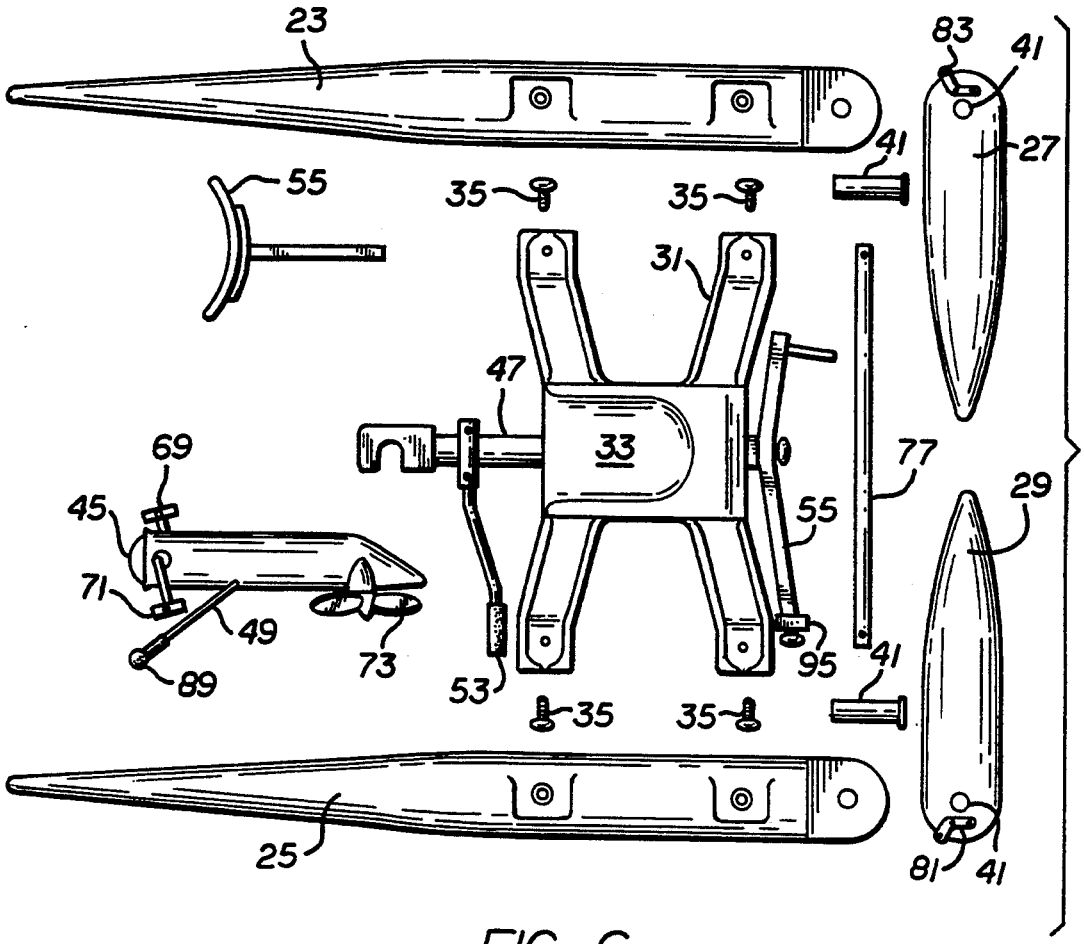
FIG. 6

FIG. 10
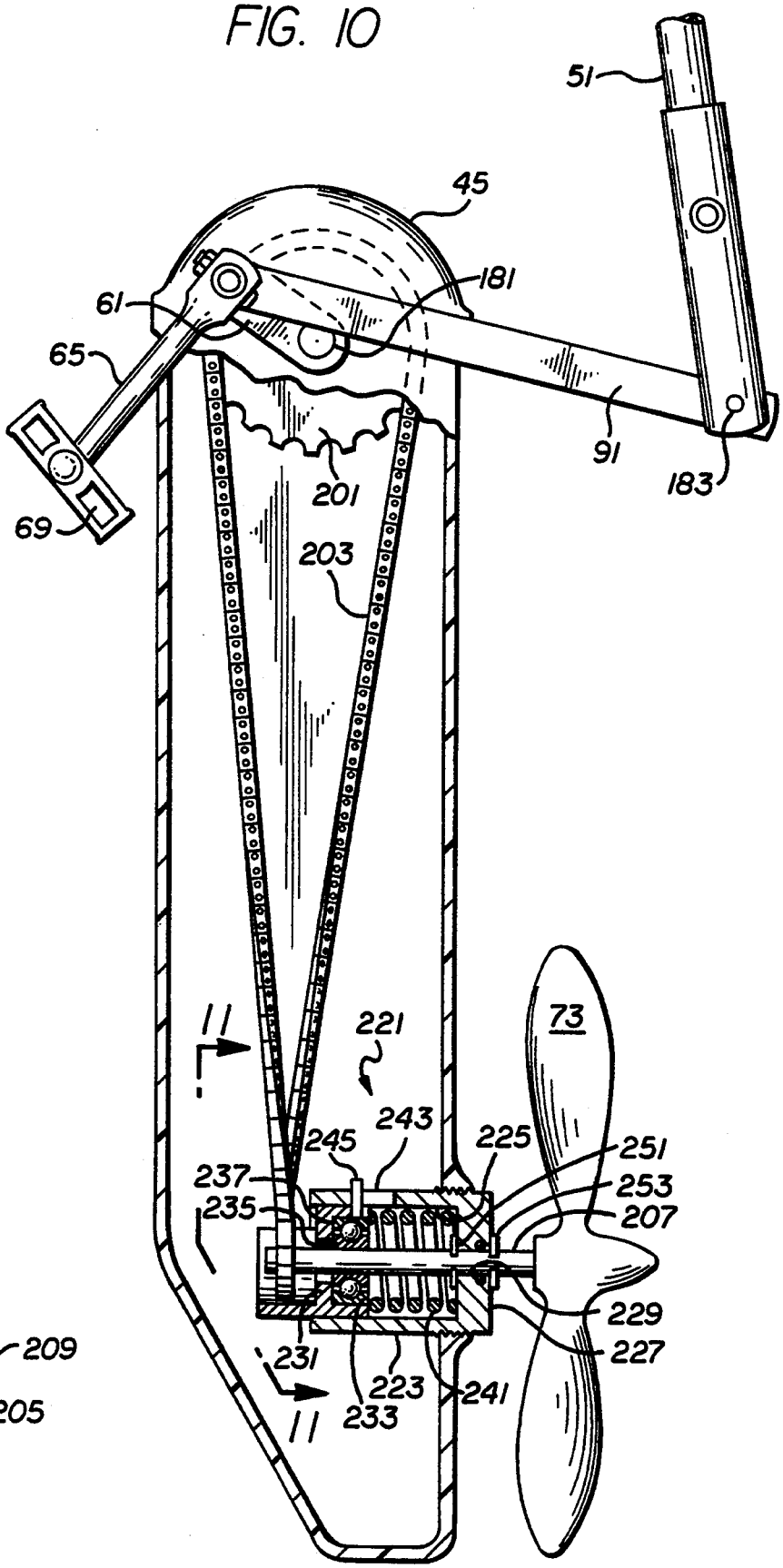
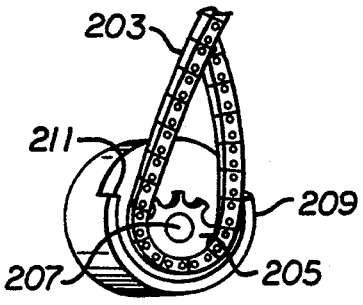
FIG. 11

PEDAL OPERATED WATERCRAFT

This is a continuation of co-pending application Ser. No. 07/819,475 filed on Jan. 10, 1992, now abandoned.

BACKGROUND OF THE INVENTION

The present invention relates to pedal operated watercraft, and more particularly to an improved pedal operated watercraft inexpensive to build with ease of handling.

U.S. Pat. No. 4,968,274 issued to Jack T. Gregory, entitled "Pedal Operated Watercraft" disclosed a watercraft having a catamaran hull system with parallel rear pontoons pivoted from the trailing end of front pontoons, for side to side oscillation in steering.

The watercraft therein was steerable from a back support, moved relative to a rigidly supported drive system. The operator of the watercraft steered by moving his back in one direction while twisting in his seat to maintain good powered engagement with the bicycle-type foot pedals.

The watercraft further included a pair of pull cords with pull handles to enable the driver's arms to powerably assist the pedal motion. The pull cords enabled power to be added from the operator's arms to the pedals during the one half turn of each pedal while it is travelling in the direction of the operator.

Mechanical power was applied from the pedals to a propeller through a rotary drive and a tubular drive shaft housing. The Pedal Operated Watercraft, as previously described, embodied many improvements over other, previously known watercraft.

As technology advances, so should improvements to novel watercraft such as those described in the above watercraft. Such improvements should include improved structure to improve the performance of the watercraft. Needed is a method of improved steering so that during the steering of the watercraft, the operator's ability to supply power to the propeller is not diminished.

Other improvements needed include a method to augment power to the pedals from the operator's arms both when a pedal is travelling toward the operator and when a pedal is travelling away from the operator. The manner of supplying mechanical power from the pedals to the propeller should be as efficient, simple and inexpensive as possible.

Since most watercraft, such as the type described above, involve the operator of the watercraft riding significantly above the water, the center of gravity of the watercraft with the rider is fairly high. The high center of gravity causes, during turning of the watercraft, the outside pontoon to dig into the water, increasing its water resistance, while causing the inside pontoon to raise up higher from within the water, decreasing its water resistance.

When turning, the outside pontoon typically travels faster than the inside pontoon, but if the outside pontoon experiences a relatively increased water resistance, over that experienced by the inside pontoon, the turning action is inhibited. What is therefore needed, by way of improvement, is a watercraft which compensates for the effect of a high center of gravity by counteracting the forces produced by the high center of gravity on turning.

SUMMARY OF THE INVENTION

The improved watercraft of the instant invention includes many design improvements over currently known watercraft, including solidly connected drive handles to augment each pedal both during the time when a pedal is moving toward and away from the operator. The improved design further includes a fully pivoting drive assembly which pivots along with the steering mechanism.

The operator turns the watercraft by leaning left or right, the operator's seat back being connected to the rudder portion of the pontoons. In leaning, the operator's seat support, drive pedals, solidly connected drive handles, and the propeller are all pivoted. For a left turn, a greater percentage of the operator's weight is shifted to the left. This shift in weight, which occurs automatically during a turn, helps to counteract the centrifugal force which would normally tend to push downwardly on the outside turning pontoon. This shift in weight therefore facilitates the turn.

In addition, since the whole drive train is tilted, the propeller pivots to the outside pontoon on a turn. The power supplied by the propeller during turning is provided while nearer the outside pontoon. As a consequence, more thrust and lift is shifted to the outside pontoon during a turn, thus facilitating the turn. In addition, the lateral offset point of thrust produces a turning moment, further facilitating the turn.

The structure for transmitting mechanical power from the pedals to the propeller is also improved, and employs a spring loaded sprocket carrying a twisted chain. The spring loaded sprocket is surrounded by a surface designed to keep the chain on the sprocket. Other design improvements relate to the overall structure of the watercraft, and will be discussed in detail in the detailed description of the preferred embodiment, below.

BRIEF DESCRIPTION OF THE DRAWINGS

Other aspects, features and advantages of the invention, its configuration, construction, and operation will be best understood from the following detailed description, taken in conjunction with the accompanying drawings in which:

FIG. 1 is a perspective view of the improved watercraft of the present invention shown in a body of water;

FIG. 2 is a top view of the improved watercraft of FIG. 1 illustrating steering movement;

FIG. 3 is a side view of the improved watercraft of FIGS. 1 and 2 illustrating the tilting movement of the drive assembly and movement of the arm drive handles;

FIG. 4 is a rear view of the improved watercraft of FIGS. 1–3 and illustrating the pivoting movement of the drive assembly, seat back support and arm drive handles;

FIG. 5 is a top view of the improved watercraft of FIGS. 1–4 in a partially disassembled state and illustrating the folding of the rear sections of the pontoons;

FIG. 6 is a top view of the improved watercraft of FIGS. 1–4 in a disassembled state with the component parts arranged;

FIG. 10 is a semi sectional side view of the drive assembly of the improved watercraft of FIGS. 1–9; and, FIG. 11 is an end view of the spring loaded bearing housing's chain guide keeper of the bearing shown in FIG. 10.

DETAILED DESCRIPTION OF THE PREFERRED EMBODIMENT

Figure 7:
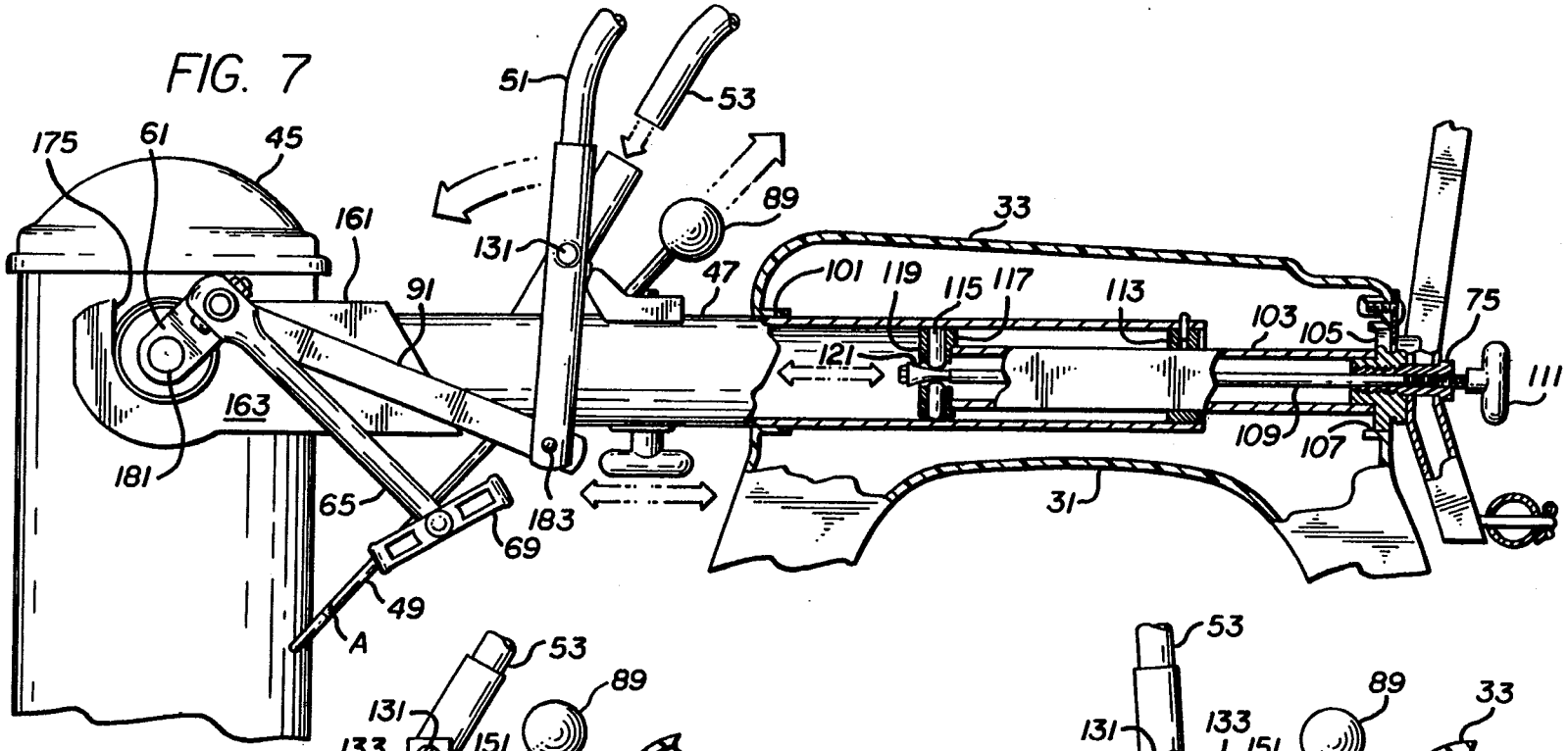
FIG. 7 is a semi sectional side view of the drive assembly of the improved watercraft of FIGS. 1–6.

Referring to FIG. 1, an improved watercraft 21 of the present invention is shown in perspective in a body of water, in a position to be operated by a user. A pair of parallel pontoon structures have forward sections 23 and 25. The pontoon structures have rearward sections 27 and 29 which are pivotally attached to the rearward ends of forward sections 23 and 25, respectively.

A frame 31 is connected to the forward sections 23 and 25 and spans the space between them. The frame 31 acts as a seat for the operator of the watercraft 21, and has an upper surface 33 which may be contoured to better accommodate the operator of the watercraft 21. The frame 31 is attached to the forward sections 23 and 25 by means of four bolts 35, each of which have an expanded area head to permit them to be installed by hand.

The rearward sections 27 and 29 of the pontoons attach to the forward sections 23 and 25 of the pontoons at a point rearward of frame 31. A series of hinge projections on the rearward ends of forward sections 23 and 25 interfit with a series of hinge projections on the forward ends of rearward sections 27 and 29. A pair of vertical pins 41 fit through the hinge projections, one of which can be seen in FIG. 1. Each vertical pin 41 forms a vertical axis about which the forward sections 23 and 25 pivot with respect to their rearward sections 27 and 29.

Also shown in FIG. 1 is a drive assembly 45, supported by a drive assembly support shaft 47 and braced by a bracing and adjustment rod 49. The drive assembly support shaft 47 supports a pair of arm drive handles 51 and 53. Drive assembly support shaft 47 also supports a vertical seat back support 55, which, in turn, supports a seat back 57. The drive assembly support shaft 47 is pivotally supported along its axis by the support 31. As the drive assembly support shaft 47 pivots, the vertical seat back support 55, seat back 57, drive assembly 45 and arm drive handles 51 and 53 also pivot.

Drive assembly 45 further includes a first set of short cranks 61 and 63 connected to a second set of longer cranks 65 and 67, which are connected to a pair of pedals 69 and 71. Drive assembly 45 rotatably supports a propeller 73, shown beneath the water's surface. Note that short crank 61 forms an angle of 90 degrees with respect to longer crank 65, as does short crank 63 forms an angle of 90 degrees with respect to longer crank 67. The significance of this angular connection will be discussed below.

Referring to FIG. 2, many of the structures previously recited in FIG. 1 can be seen more clearly. In addition, the vertical seat back support 55 is attached to a fitting 75 which is attached to a reduced diameter drive assembly support shaft (not shown). This reduced diameter drive assembly support shaft fits within the drive assembly support shaft 47, and is adjustable with respect thereto to enable the forward displacement of drive assembly support shaft 47 to be adjusted to accommodate a wide variety of different sized operators.

The bottom end of vertical seat back support 55 extends below its point of attachment to fitting 75, and attaches to a tiller bar 77 along the length of tiller bar 77. One end of the tiller bar 77 is attached to a bracket 81 on the hinge projection of rearward section 29, and the other end of the tiller bar 77 is attached to a bracket 83 on the hinge projection of rearward section 27. Since brackets 81 and 83 are forward of the vertical pins 41 which fit through the hinge projections of rearward sections 27 and 29, lateral motion of the tiller bar 77 in one direction will cause the rearward ends of rearward sections 27 and 29 to move in the opposite direction.

Brackets 81 and 83 are boomerang shaped. If they were right angled, they would cause the pontoon rearward sections 27 and 29 which slows the boat on a turn due to water compressing between them. Such parallel movement would also cause both pontoon rearward sections 27 and 29 to try to turn in the same arc, which is not efficient. The pontoon on the inside of the turn should turn in a smaller arc than the arc on the outsider for best efficiency.

As a result of this connection, when the operator leans to the right, the bottom end of the vertical seat back support 55 and tiller bar 77 are moved to the left, causing the trailing end of rearward sections 27 and 29 of the pontoons to move laterally to the right, in the direction of a right turn. The same logic applies to movement to effect a left turn.

In FIG. 2, a knob 89 is visible atop the bracing and adjustment rod 49, which was visible in FIG. 1. Knob 89 facilitates the operation and longitudinal adjustment of the bracing and adjustment rod 49 which may be use to angle drive assembly 45 from the water.

Referring to FIG. 3, a side view is more illustrative of the movement and connections regarding the arm drive handles 51 and 53. The arm drive handles pivotally oscillate in the forward to aft directions. The bottom of the arm drive handles 51 and 53 are connected to a pair of drive rods 91 and 93, which are in turn connected to the ends of the first set of short cranks 61 and 63. In this manner, the arm drive handles 51 and 53 are mechanically connected to the drive assembly 45 in a manner 90 degrees out of phase with respect to the pedals 69 and 71.

In this way, the power strokes will not be coordinated. The power stroke applied to a pedal will occur midway between a prior and a later power stroke applied through the arm drive handles 51 and 53. This results in a four stroke power application to each series of spins at the propeller 73, rather than two widely spaced surges. With a two stroke power cycle, the propeller 73 unduly surges during the power strokes. With a four stroke power application, there is a more continuous propeller 73 rpm, with little or none of the inefficient surges.

The tilting action of the drive assembly 45 is also illustrated as ranging from a generally vertical position toward a slanted position bringing the lower portion of the drive assembly back and under the frame 31. Drive assembly support shaft 47 operates with a detent mechanism to be more fully illustrated below, and is designed to brace adjustment rod 49 at two positions, namely a fully downwardly extended position and an upward fully retracted position. Also shown is an adjustment 95 which enables the seat back 57 to be adjusted forwardly or aftwardly with respect to seat back support 55.

Referring to FIG. 4, the pivoting of the drive assembly support shaft 47 along with the vertical seat back support 55, seat back 57, drive assembly 45 and arm drive handles 51 and 53 are shown. Note that as the drive assembly 45 is pivoted, the position of the propeller 73 is brought into closer proximity with one or the other of the forward sections 23 or 25 of the pontoons. The drive power from the propeller 73 therefore will, during pivot, supply motive power at a point nearer one of the forward sections 23 or 25 of the pontoons than the other. The placement of motive power nearer one of the forward sections 23 or 25 will cause the proximate pontoon to be urged forward with a greater force and lift than the other pontoon. Such relative force will cause the water craft 21 to turn, independent of other considerations, such as the angle of the rearward sections 27 and 29 of the pontoons.

Referring to FIG. 5, the watercraft 21 can be disassembled by disconnecting the tiller bar 77 from the fitting 75 and the brackets 81 and 83. Once this is done, and the drive assembly 45 and the seat back 57 is removed, the fitting 75 and the drive assembly support shaft 47 are pivotable to a horizontal or beyond rest position, and the rearward sections 27 and 29 of the pontoons may be folded inwardly. Note the arm drive handles 51 and 53 are pivoted downwardly into rest position along with vertical seat back support 55.

FIG. 6 illustrates complete disassembly of the major structural portions of the water craft 21 of the present invention. Once the water craft 21 is disassembled to the condition shown in FIG. 5, the frame 31 may be removed by the removal of the four bolts 35, and lifting frame 31 off of the forward sections 23 and 25 of the pontoons.

The vertical pins 41, which fit through the hinge projections of the forward sections 23 and 25 and rearward sections 27 and 29, may be lifted upwardly to disengage the forward sections 23 from the rearward section 27 and to disengage the forward section 25 from the rearward section 29. FIG. 6 shows the layout of all of the components, including those which were removed to achieve the configuration of FIG. 5.

Referring to FIG. 7, the support provided to the drive assembly support shaft 47 by the frame 31 is illustrated by a sectional view through frame 31. The larger diameter drive assembly support shaft 47 extends from an aperture 101 formed in frame 31, while a smaller diameter drive assembly support shaft 103 terminates into a bearing 105 supported within an aperture 107 at the aft end of frame 31.

The fitting 75 is seen to have an annular shape, the external portion of fitting 75 extending within the internal portion of the bearing 105. Fitting 75 has an internally threaded surface, in threaded engagement with a rod 109 extending through the fitting 75 and the smaller diameter drive assembly support shaft 103. At the end of rod 109 nearer the fitting 75, a handle 111 is affixed to the rod 109 to enable manual turning of rod 109 within the threads provided by the internal portion of fitting 75. Rotation of the handle 111 causes rod 109 to both rotate and become axially displaced both with respect to fitting 75 and smaller diameter drive assembly support shaft 103.

At the aftward end of drive assembly support shaft 47, the smaller diameter drive assembly support shaft 103 enters drive assembly support shaft 47 through a bearing 113. At the forward end of smaller diameter drive assembly support shaft 103 is an expansion bearing 115 mounted against a plate 117 at the end of smaller diameter drive assembly support shaft 103, and bounded by a plate 119 located opposite plate 117 with respect to expansion bearing 115. The rod 109 extends through the plate 117 expansion bearing 115 and plate 119.

It can be clearly seen that if the knob 111 is turned in a direction which will displace rod 109 aftward, that the plate 119 will compress the expansion bearing 115 against the plate 117, causing it to radially expand and bear against the internal surface of drive assembly support shaft 47, thereby fixing the axial displacement of drive assembly support shaft 47 forward of frame 31. In this manner, the forward location of the arm drive handles 51 and 53, and the pedals 69 and 71 can be adjusted to accommodate operators of the water craft 21, of different sizes.

Figure 9:
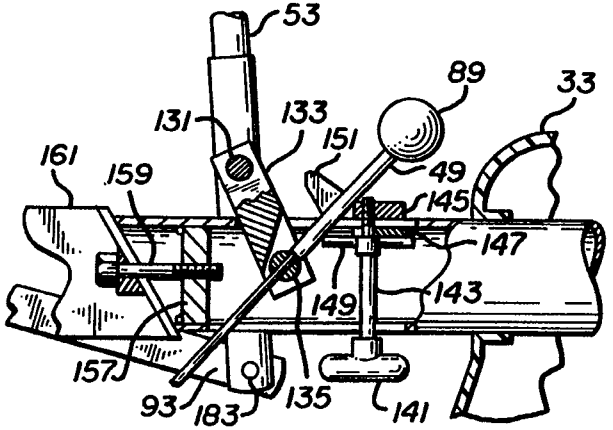
FIG. 9 is a semi sectional side view of the adjustable tilt and adjustable arm drive handle position adjustment where the arm drive handles are adjusted relatively forward.
Figure 8:
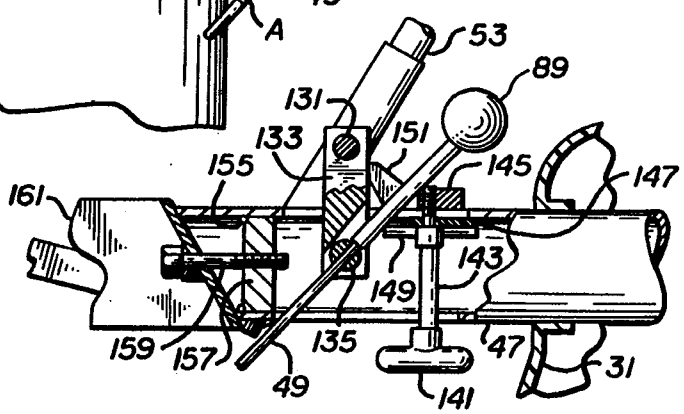
FIG. 8 is a semi sectional side view of the adjustable tilt and adjustable arm drive handle position adjustment where the arm drive handles are adjusted relatively aftward.

Referring to FIGS. 7, 8, and 9, the axis about which the arm drive handles 51 and 53 pivot can be adjusted. The arm drive handles 51 and 53 pivot about a shaft 131. The shaft is supported by block 133. The block 133 is supported about a shaft 135, and shaft 135 is supported within the drive assembly support shaft 47. The shaft 135 has a bore at its center, perpendicular to its length, through which bracing and adjustment rod 49 extends.

An adjustment fitting is slidable with respect to drive assembly support shaft 47, and consists of a handle 141 fixably attached to a vertical rod 143. A fitting block 145 receives the threaded end of the vertical rod 143. A friction bearing 147 is sandwiched between the internal portion of drive assembly support shaft 47 and a plate 149 supported by vertical rod 143. A forwardly directed projection 151 on the fitting block 145 extends forward to bearingly engage the block 133. The forward extent of the position of the fitting block 145 determines the aftward extent of the position of shaft 131, to accommodate an operator's arm length. In operation, the arm drive handles 51 and 53 will generally have an aftward urge, eliminating the necessity for a forward position limiter for the shaft 131 within block 133. The forward motion of one of the arm drive handles 51 or 53 will be taken relatively with respect to the aftward motion of the other of the arm drive handles 51 or 53. The relative motions, coupled with an overall aftward pull does not require a forward limitation for block 133.

Fitting block 145 has a slot to accommodate the presence of adjustment rod 49. The fitting block 145 does not interact with the adjustment rod 49. Adjustment rod 49 has grooves, one of which, groove A, is visible in FIG. 7. The grooves operate in conjunction with a detent mechanism (not shown) within the shaft 135. Since, in normal operation, the propeller 73 will be urging the drive assembly 45 forwardly, the fully extended orientation of adjustment rod 49 will not act against any detent mechanism. Only when pedaling in reverse would forces act on the detent mechanism. Normally, during reverse thrust, very little force is applied. The projections 151 accommodate the adjustment rod 49 by extending about the adjustment rod 49.

The handle 141 is turnable to loosen the fitting block 145. Once the fitting block 145 is loosened, it can be moved aftwardly to free the block 133. The handle 141 can be turned again to lock the adjustment rod 49 in place. Adjustment rod may, for convenience be made of two lengths of rod with a joining threaded end and internally threaded sleeve.

Once the tilt of the block 133 is determined for the proper displacement of the axis of pivot for the pair of armdrive handles 51 and 53, the handle 141 and the vertical shaft 143 can again be turned to lock the block 133 back into place.

A wire ring 155 secures a round bolt mount 157 within the forward portion of the drive assembly support shaft 47. A bolt 159 is threadably inserted into the round bolt mount 157 and secures a drive yoke 161. The drive yoke 161 includes a pair of forks 163 (only one of the forks 163 is shown in FIG. 7). A fitting 171 supports the drive assembly 45. The fitting 171 enables the tilting of drive assembly 45, enabling the drive assembly 45 to be tilted with respect to the forks 163.

A main shaft 181 is connected to the first set of short cranks 61 and 63. As is more clearly seen in FIG. 7, the drive rods 91 and 93 connect to the first set of short cranks 61 and 63 at a point where the first set of short cranks 61 and 63 are connected to the second set of longer cranks 65 and 67. The right angled relationship between the first set of short cranks 61 and 63 and the second set of longer cranks 65 and 67 has been previously discussed with respect to the production of a four cycle power stroke. Also observable in FIG. 7 are the rivets 183 which pivotally connect the drive rods 91 and 93 to the lower ends of the arm drive handles 51 and 53.

Referring to FIGS. 10 and 11, a partial sectional view of the drive assembly 45 is detailed. The main shaft 181 is attached to and rotatable with a main sprocket 201. Main sprocket 201 engages a chain 203. Chain 203 extends downwardly within drive assembly 45 in a twisting fashion. Chain 203 engages a driven sprocket 205 which is fixed to a propeller shaft 207. Note the axis of the main shaft 181 extends laterally with respect to the watercraft 21, while the propeller shaft 207 extends parallel to the length of watercraft 21. This is enabled by the gentle twisting of the chain 203 along its length between the driven sprocket 205 and the main sprocket 201.

About the lower half of the driven sprocket 205 is a chain guide keeper 209. Chain guide keeper 209 has an inwardly disposed surface 211 which is disposed in close relation to chain 203 as it rounds the driven sprocket 205. The relationship is so close as to prevent the chain 203 from becoming dislodged from the driven sprocket 205, despite the chain 203's enhanced tendency to do so due to its being twisted, and due to the size of the driven sprocket 205, which is so small that only three to four of its teeth engage the chain 203.

The propeller shaft 207, driven sprocket 205 and chain guide keeper 209 are supported by a bearing assembly 221. Bearing assembly 221 has a cylindrically shaped bearing housing 223, held within the drive assembly 45. Bearing housing 223 has an internal cavity 225 which is open at one end has a plate 227 defining a bore 229 at the other end. The bore 229 supports the propeller shaft 207.

A cylindrically shaped bearing support 231 is a circular plate having a first side defining a cylindrical wall 233 and a second side to which the chain guide keeper 209 is attached. A cylindrical shaped bearing fitted within said cylindrical wall 233 is preferably a ball bearing having an inner race 235 supporting said propeller shaft 207, and an outer race 237 supported by the cylindrical wall 233. A spring 241 is in urging contact between the cylindrically shaped bearing housing 223 and the cylindrical shaped bearing support 231.

At the top end of bearing support 231, a slot 243 extends parallel to the propeller shaft 207. A pin 245 is attached to the bearing support 231 and extends through the slot 243, and rides in the slot 243. The bearing support 231 may be pressed into the bearing housing 223 to cause the pin 245 to ride in the slot. When the bearing support 231 is be pressed into the bearing housing 223, the chain guide keeper 209 is recessed into the bearing housing 223 and enables the chain 203 to be removed from the driven sprocket 205.

The pin 245 within the slot 243 acts as a stop structure for limiting the extent of displacement of said cylindrical shaped bearing support 231 out of said cylindrically shaped bearing housing 223. A set of locking rings 251 and 253 surround the propeller shaft 207, and axially fix the propeller shaft 207 with respect to the bearing housing 223. As can be seen from FIG. 10, the brunt of the bearing force is borne by the bearing, including inner and outer races 235 and 237, respectively.

Although we have described our invention by reference to particular illustrative embodiments thereof, many changes and modifications of the invention will be apparent to those skilled in the art without departing from the spirit and scope of the invention. We therefore intend to include within the scope of the present invention all such changes and modifications as may reasonably and properly be encompassed by this contribution to the art.

What is claimed is:

1. An improved watercraft comprising:

a hull system further comprising:

a first and second pontoon each having a forward section and a rearward section pivotable with respect to said forward section about a generally vertical axis;

a frame attached between the forward section of said first pontoon and the forward section of said second pontoon;

means, connected to and extending below said hull system, for propelling said watercraft;

means for pivoting said rearward sections of said pontoons with respect to said forward sections of said pontoons; and means for pivoting said means for propelling about a horizontal axis parallel to said first and second pontoons while said watercraft is being propelled by said means for propelling.

2. The improved watercraft system as recited in claim 1, wherein said means for pivoting, pivots said means for propelling simultaneously with said rearward sections of said pontoons.

3. The improved watercraft system as recited in claim 1, wherein an axis of pivot between said forward section and said rearward section of said first and second pontoons is formed by an interlacing hinge.

4. The improved watercraft system as recited in claim 1, wherein said means for pivoting said rearward sections of said pontoons further comprises:

an operator's back support pivotally connected to said frame; and, a tiller linkage connected between the rearward sections of said pontoons and said operator's back support.

5. The improved watercraft system as recited in claim 4, wherein said tiller linkage is connected to said rearward sections of said first and second pontoons forward of said generally vertical axis.

6. The improved watercraft system as recited in claim 1, wherein said means for propelling is adjustable toward and away from said frame.

7. The improved watercraft system as recited in claim 1, wherein the forward end of said forward portion and the rearward end of said rearward portion, of said first and second pontoons is tapered.

8. The improved watercraft system as recited in claim 1, wherein said means for propelling said watercraft further comprises:

a drive assembly support shaft, axially pivotally supported at one end by said frame;

a pair of support forks attached to the other end of said drive assembly support shaft; and a drive assembly fitted between said pair of support forks.

9. The improved watercraft system as recited in claim 8, wherein said drive assembly further comprises:

a drive assembly housing;

a main shaft, having a first end and a second end, and rotatably supported by said drive assembly housing at the upper end of said drive assembly housing;

a main drive sprocket fixably supported by and rotatable with said main shaft;

crank means, connected to said first and second ends of said main shaft, facilitating the turning of said main shaft;

a pair of pedals, connected to said crank means;

a propeller shaft having a first end and a second end;

a propeller attached to said first end of said propeller shaft;

a bearing assembly, supported by said drive assembly housing near the lower end of said drive assembly housing, rotatably supporting said propeller shaft;

a propeller shaft sprocket attached to said second end of said propeller shaft; and, a chain surrounding said propeller shaft sprocket and said main drive sprocket, for transmitting mechanical energy between said propeller shaft sprocket and said main drive sprocket.

10. The improved watercraft system as recited in claim 9, wherein said bearing assembly further comprises:

a cylindrically shaped bearing housing having an internal cavity and open at one end and having a plate defining a bore at the other end;

a cylindrical shaped bearing support having a circular plate having a first side and a second side and defining a central bore, and a first cylindrical wall extending from the periphery of said first side of said plate, and a second cylindrical wall extending from a portion of the periphery of said second side of said plate, to form a chain guide keeper, said cylindrical shaped bearing fitted within said cylindrically shaped bearing housing;

a ball bearing having an inner race supporting said propeller shaft, and an outer race supported by said first side of said plate and said first cylindrical wall;

a spring in urging contact between said plate of said cylindrically shaped bearing housing and said first cylindrical wall of said cylindrical shaped bearing support;

stop means between said cylindrically shaped bearing housing and said first cylindrical wall of said cylindrical shaped bearing support, for limiting the extent of displacement of said cylindrical shaped bearing support out of said cylindrically shaped bearing housing.

11. The improved watercraft system as recited in claim 9, wherein said crank means further comprises:

a first crank having a first end connected to said first end of said main shaft, and a second end;

a second crank having a first end connected to said second end of said main shaft, and a second end;

a third crank having a first end connected to said second end of said first crank, and a second end connected to one of said pair of pedals; and, a fourth crank having a first end connected to said second end of said second crank, and a second end connected to the other of said pair of pedals.

12. The improved watercraft system as recited in claim 9, further comprising:

a first arm drive handle having a first end, a second end and pivotally supported from said drive assembly support shaft about an axis located between said first and second ends of said first arm drive handle;

a first drive link having a first end connected to said second end of said first arm drive handle, and a second end connected to said second end of said first crank;

a second arm drive handle having a first end, a second end and pivotally supported from said drive assembly support shaft about an axis located between said first and second ends of said second arm drive handle; and, a second drive link having a first end connected to said second end of said second arm drive handle, and a second end connected to said second end of said second crank.

13. The improved watercraft system as recited in claim 9, wherein said main shaft is at a right angle with respect to said propeller shaft.

14. An improved watercraft comprising:

a hull system further comprising:

at least a first and second pontoon each having an elongate axis, the axes of said first and second pontoons generally parallel to each other;

a frame attached between said first pontoon and said second pontoon;

means, connected to and extending below said hull system, for propelling said watercraft;

means for pivoting said means for propelling about a horizontal axis parallel to the axes of said first and second pontoons while said watercraft is being propelled by said means for propelling;

wherein said means for propelling further comprises:

a drive assembly housing, axially pivotally supported by said frame;

a main shaft, having a first end and a second end, and rotatably supported by said drive assembly housing at the upper end of said drive assembly housing;

a main drive sprocket fixably supported by and rotatable with said main shaft;

crank means, connected to said first and second ends of said main shaft, facilitating the turning of said main shaft;

a pair of pedals, connected to said crank means;

a propeller shaft having a first end and a second end;

a propeller attached to said first end of said propeller shaft;

a bearing assembly, supported by said drive assembly housing near the lower end of said drive assembly housing, rotatably supporting said propeller shaft;

a propeller shaft sprocket attached to said second end of said propeller shaft; and, a chain surrounding said propeller shaft sprocket and said main drive sprocket, for transmitting mechanical energy between said propeller shaft sprocket and said main drive sprocket.

15. The improved watercraft system as recited in claim 14, further comprising keeper means, partially surrounding said propeller shaft sprocket, for preventing said chain from becoming disengaged with said propeller shaft sprocket.

16. The improved watercraft system as recited in claim 15 wherein said keeper means is springingly urged into its surrounding position in a direction parallel to the axis of said propeller shaft.

* * * * *